US010029872B2

(12) United States Patent
Shiba

(10) Patent No.: US 10,029,872 B2
(45) Date of Patent: Jul. 24, 2018

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Tetsuo Shiba, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/458,211

(22) Filed: Mar. 14, 2017

(65) Prior Publication Data

US 2017/0183180 A1 Jun. 29, 2017

Related U.S. Application Data

(63) Continuation of application No. 14/790,707, filed on Jul. 2, 2015, now Pat. No. 9,630,792.

(51) Int. Cl.
*B65H 1/04* (2006.01)
*B65H 1/26* (2006.01)
(Continued)

(52) U.S. Cl.
CPC ..... *B65H 9/04* (2013.01); *B65H 1/04* (2013.01); *B65H 1/266* (2013.01); *B65H 9/08* (2013.01);
(Continued)

(58) Field of Classification Search
CPC . B65H 3/54; B65H 1/04; B65H 1/266; B65H 2511/12
See application file for complete search history.

(56) References Cited

U.S. PATENT DOCUMENTS 7,967,288 B2 6/2011 Nishinakama
2008/0084021 A1 4/2008 Nakamura
(Continued)

FOREIGN PATENT DOCUMENTS

JP 61033441 2/1986
JP 04112141 4/1992
(Continued)

OTHER PUBLICATIONS

Non-Final Office Action for U.S. Appl. No. 14/790,707 dated Jan. 20, 2016, 24 pages.
(Continued)

*Primary Examiner* — Luis A Gonzalez
(74) *Attorney, Agent, or Firm* — Amin, Turocy & Watson LLP

(57) ABSTRACT

A paper feeding unit of an image forming apparatus according to an exemplary embodiment is provided with a base portion, a guide, a protruding portion, and a roller. The base portion is capable of having the sheet placed thereon. The guide erects with respect to the base portion. The guide regulates a position of the sheet in a width direction which intersects with a transporting direction of the sheet. The protruding portion is provided on the guide. The protruding portion faces an end portion of the sheet in the width direction from a side opposite to the base portion. The roller is provided on the protruding portion. The roller is provided with a circumferential surface facing the end portion of the sheet. The roller is rotatable in the transporting direction of the medium.

14 Claims, 6 Drawing Sheets

(51) Int. Cl.

| | |
|---|---|
| ***B65H 9/04*** | (2006.01) |
| ***B65H 9/08*** | (2006.01) |
| ***G03G 15/00*** | (2006.01) |

(52) U.S. Cl.
CPC ..... *G03G 15/6529* (2013.01); *B65H 2402/45* (2013.01); *B65H 2511/12* (2013.01); *B65H 2801/06* (2013.01)

(56) References Cited

U.S. PATENT DOCUMENTS

| | | | |
|---|---|---|---|
| 2009/0206544 | A1 | 8/2009 | Allwright |
| 2015/0123341 | A1 | 5/2015 | Hirata et al. |

FOREIGN PATENT DOCUMENTS

| | | | | |
|---|---|---|---|---|
| JP | 10129858 | | | 5/1998 |
| JP | 2000313530 | A | * | 11/2000 |
| JP | 2001106362 | A | * | 4/2001 |
| JP | 2003276859 | | | 10/2003 |
| JP | 2006008337 | | | 1/2006 |

OTHER PUBLICATIONS

Final Office Action for U.S. Appl. No. 14/790,707 dated Aug. 11, 2016, 11 pages.

* cited by examiner

IMAGE FORMING APPARATUS

CROSS-REFERENCE TO RELATED APPLICATIONS

This application is a Continuation of application Ser. No. 14/790,707 filed on Jul. 2, 2015, the entire contents of which are incorporated herein by reference.

FIELD

Embodiments described herein relate generally to an image forming apparatus.

BACKGROUND

An image forming apparatus which is provided with a manual paper feeding tray has been known. The manual paper feeding tray generally is provided with a base portion on which a sheet can be placed and a guide which regulates a position of the sheet in a width direction.

In this type of the paper feeding tray, there are some cases where sheets which have been used to print once (hereinafter, refer to as a back paper) may be supplied. Typically, the back paper is likely to be curled. For this reason, a protruding portion which presses the curling from the side opposite to the base portion is provided on the guide.

Meanwhile, in recent years, recording media which are used in the image forming apparatus have been diversified. For example, the sheet which has strong stiffness (for example, thick paper) compared to the typical recording medium may be supplied to the paper feeding tray in some cases.

The sheet having the strong stiffness is likely to be curled as a case of the typical sheet. When the sheet having the strong stiffness is curled, a load of contacting the curl and the protruding portion of the paper feeding tray becomes larger. For this reason, when the sheet having the strong stiffness is curled, the transport failure is likely to be generated.

DETAILED DESCRIPTION

Figure 1:
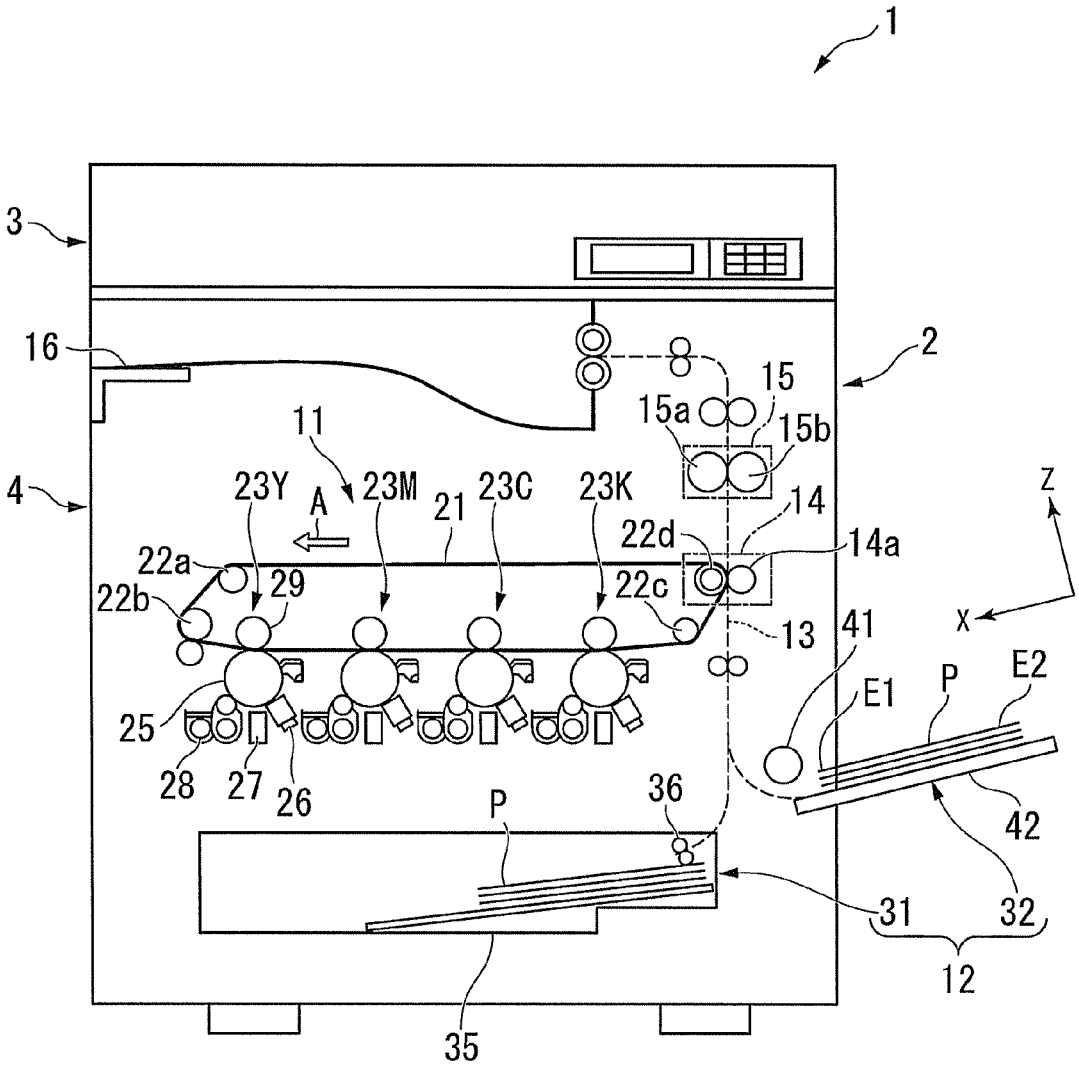
FIG. 1 is a diagram schematically illustrating a configuration example of an image forming apparatus according to an embodiment.

A paper feeding unit of an image forming apparatus according to an exemplary embodiment is provided with a base portion, a guide, a protruding portion, and a roller. The base portion is capable of having the sheet placed thereon. The guide erects with respect to the base portion. The guide regulates a position of the sheet in a width direction which intersects with a transporting direction of the sheet. The protruding portion is provided on the guide. The protruding portion faces an end portion of the sheet in the width direction from a side opposite to the base portion. The roller is provided on the protruding portion. The roller is provided with a circumferential surface facing the end portion of the sheet. The roller is rotatable in the transporting direction of the medium.

Hereinafter, the image forming apparatus of the exemplary embodiment will be described with reference to the drawings. Note that, in the following description, the same or equivalent components are denoted by the same reference numerals. Then, the description thereof will not be repeated.

FIG. 1 illustrates a configuration example of the image forming apparatus 1 according to the exemplary embodiment. As illustrated in FIG. 1, the image forming apparatus 1 is an electrographic multi function peripheral (MFP).

First, the entire configuration of the image forming apparatus 1 will be described.

The image forming apparatus 1 is provided with a housing 2, a scanning portion 3, and a printing portion 4.

The housing (a body or a case) 2 forms an outline of the image forming apparatus 1. The housing 2 is formed into a, for example, box shape. The housing 2 accommodates the scanning portion 3 and the printing portion 4.

The scanning portion 3 reads out image information of an original document as digital data.

The printing portion 4 forms an image on the sheet, based on image data. The image forming apparatus 1 forms an image by using a recording agent. For example, the recording agent is toner.

Next, the printing portion 4 will be described in detail.

The printing portion 4 is provided with an intermediate transfer portion 11, a paper feeding unit 12, a transporting path 13, a secondary transfer portion 14, a fixing portion 15, a paper discharging portion 16.

The intermediate transfer portion (a primary transfer portion) 11 is provided with an intermediate transfer belt 21, a plurality of rollers 22*a*, 22*b*, 22*c*, and 22*d*, and a plurality of image forming portions 23Y, 23M, 23C, and 23K.

The intermediate transfer belt 21 is formed in an endless state. The plurality of rollers 22*a*, 22*b*, 22*c*, and 22*d* support the intermediate transfer belt 21. Accordingly, the intermediate transfer belt 21 is capable of endless belt traveling in the direction illustrated by an arrow A in FIG. 1.

The plurality of image forming portions (a process unit) 23Y, 23M, 23C, and 23K includes a yellow image forming portion 23Y, a magenta image forming portion 23M, a cyan image forming portion 23C, and a black image forming portion 23K. The image forming portions 23Y, 23M, 23C, and 23K respectively include a photosensitive drum 25, a charging portion 26, an exposure portion 27, a developing portion 28, and a transfer roller 29. The configurations of the image forming portions 23Y, 23M, 23C, and 23K are the same as each other except for color of the recording agent thereof.

The charging portion (an electrostatic charger) 26 causes a surface of the photosensitive drum 25 to be charged.

The exposure portion (a scanning exposure head) 27 exposes a surface of the photosensitive drum 25. With this, an electrostatic latent image is formed on the surface of the photosensitive drum 25 based on image data.

The developing portion 28 is capable of accommodating the recording agent which corresponds to each color. The developing portion 28 supplies the recording agent onto the surface of the photosensitive drum 25. With this, the recording agent is attached to a latent image portion of the photosensitive drum 25.

The transfer roller 29 faces the intermediate transfer belt 21 from the side opposite to the photosensitive drum 25. With this, the recording agent is transferred (a primary transfer) to the intermediate transfer belt 21 from the surface of the photosensitive drum 25.

Next, the paper feeding unit 12, the transporting path 13, the secondary transfer portion 14, the fixing portion 15, and the paper discharging portion 16 will be described.

The paper feeding unit 12 is provided with a paper feeding cassette portion 31 and a manual mechanism portion 32.

The paper feeding cassette portion 31 is provided with a paper feeding cassette 35 and a pick-up roller 36. The paper feeding cassette 35 is placed on the housing 2. The paper feeding cassette 35 can be drawn from the housing 2. The paper feeding cassette 35 can accommodate a sheet P on which the image is printed. The pick-up roller 36 is provided on the paper feeding cassette 35. The pick-up roller 36 transports the sheet P which is accommodated in the paper feeding cassette 35 to the transporting path 13.

The manual mechanism portion 32 is provided on a side surface portion of the housing 2. The manual mechanism portion 32 includes a part positioned on the outer portion of the housing 2. The manual mechanism portion 32 is capable of supplying the sheet P to an inside of the housing 2. Meanwhile, the manual mechanism portion 32 will be described later in detail.

The transporting path 13 reaches the paper discharging portion 16 via the secondary transfer portion 14 and the fixing portion 15 from the paper feeding unit 12. The sheet P is transported to the transporting path 13.

The secondary transfer portion 14 is provided with a transfer roller 14*a*. The transfer roller 14*a* comes in contact with the outer surface of the intermediate transfer belt 21. One belt roller 22*d* which supports the intermediate transfer belt 21 is included in the secondary transfer portion 14 as a component. The belt roller 22*d* faces the transfer roller 14*a* interposing the intermediate transfer belt 21 therebetween. The sheet P is interposed between the transfer roller 14*a* and the belt roller 22*d* with the intermediate transfer belt 21. With this, the recording agent on the intermediate transfer belt 21 is transferred to the surface of the sheet P (a secondary transfer). The sheet P which passes through the secondary transfer portion 14 is transported to the fixing portion 15.

The fixing portion 15 is provided with a heat roller 15*a* and a press roller 15*b*. A temperature of the heat roller 15*a* is controlled to be a fixing temperature (a printing temperature) which is suitable for fixing the recording agent. The press roller 15*b* faces the sheet P from the side opposite to the heat roller 15*a*. The sheet P to which the recording agent is transferred is interposed between the heat roller 15*a* and the press roller 15*b*. With this, the sheet P is heated and pressed between the heat roller 15*a* and the press roller 15*b*. With this, the recording agent which is transferred to the sheet P is fixed to the sheet P.

The paper discharging portion 16 discharges the sheet P which passes through the fixing portion 15.

Next, the manual mechanism portion 32 will be described in detail.

Here, an X direction, a Y direction, and a Z direction will be defined. The X direction and the Y direction are directions along an upper surface 51*a* of the base portion 51 of the manual mechanism portion 32 (refer to FIG. 2). The X direction is the transporting direction of the sheet P in the base portion 51. That is, the X direction is the direction toward the housing 2 from the base portion 51 of the manual mechanism portion 32. The Y direction is the direction intersecting with (for example, substantially orthogonal to) the X direction. The Y direction is the width direction of the sheet P. The Z direction is the direction intersecting with (for example, substantially orthogonal to) the X direction and the Y direction. The Z direction is the direction substantially perpendicular to the upper surface 51*a* of the base portion 51. The Z direction is the thickness direction of the sheet P.

In addition, for the easy understanding of the description, a first end portion E1 and a second end portion E2 of the sheet P will be defined. As illustrated in FIG. 1, the first end portion E1 is an end portion which is positioned on the X direction side in a state where the sheet P is placed on the base portion 51 of the manual mechanism portion 32. In other words, the first end portion E1 is a front end of the sheet P with respect to the transporting direction of the sheet. On the other hand, the second end portion E2 is an end portion which is positioned on the side opposite to the first end portion E1. In other words, the second end portion E2 is a rear end of the sheet P with respect to the transporting direction of the sheet.

Figure 2:
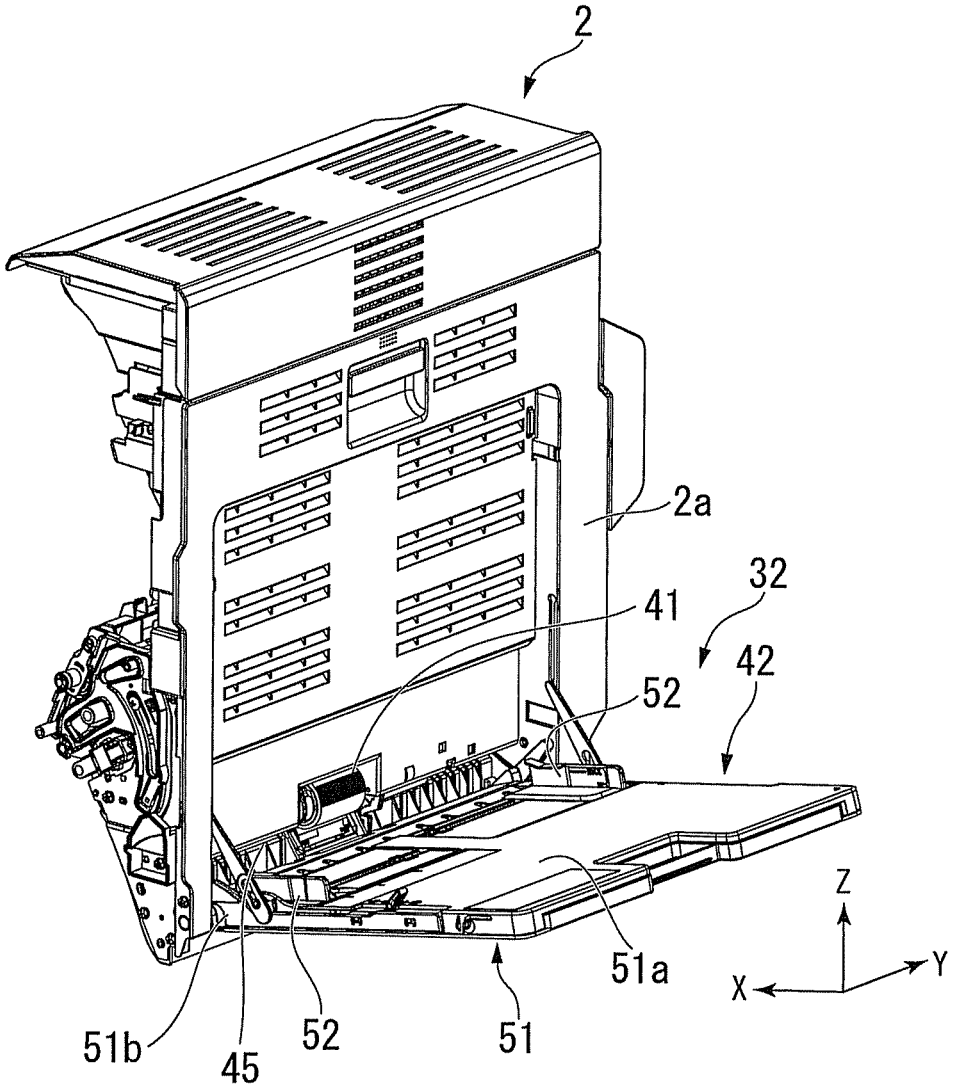
FIG. 2 is a perspective view illustrating a manual mechanism unit as illustrated in FIG. 1.
Figure 3:
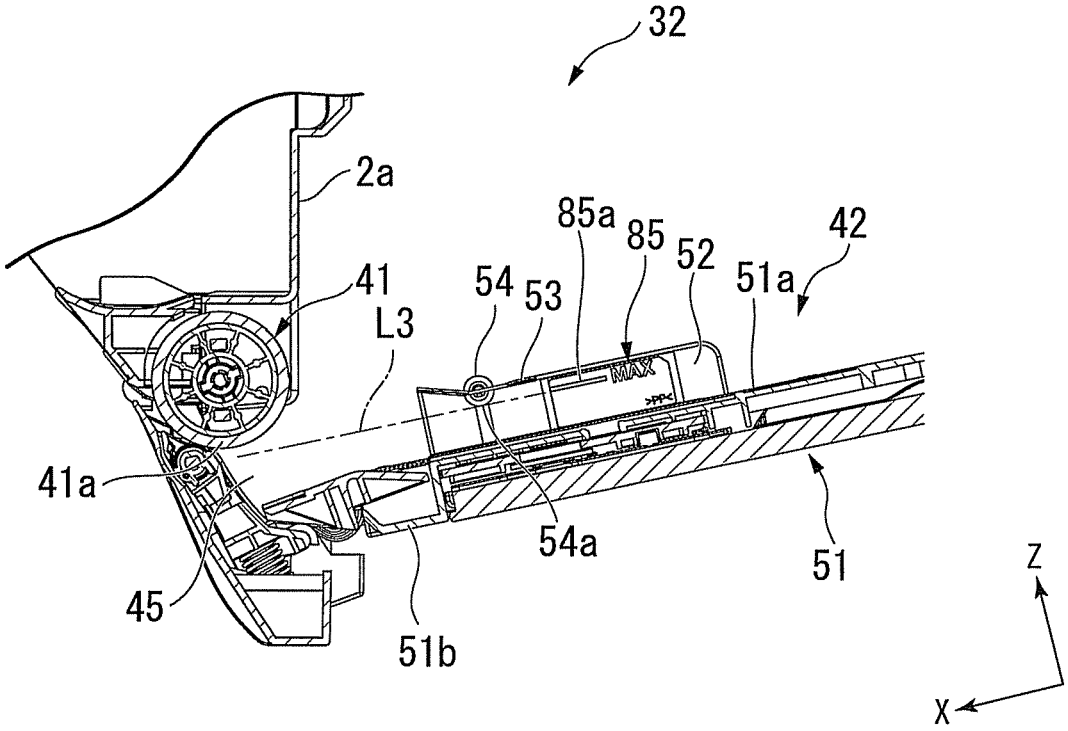
FIG. 3 is a sectional view illustrating the manual mechanism unit as illustrated in FIG. 1.

FIG. 2 and FIG. 3 illustrate the manual mechanism portion 32. As illustrated in FIG. 2 and FIG. 3, the manual mechanism portion 32 is provided with a paper feeding roller 41 and a paper feeding tray (a manual feeding tray) 42.

First, the paper feeding roller 41 will be described.

A side wall 2*a* of the housing 2 is provided with a sheet importing port 45. The sheet P is guided into the housing 2 from the sheet importing port 45. The paper feeding roller 41 is adjacent to the sheet importing port 45. The paper feeding roller 41 is positioned on the upper side of the sheet importing port 45. The sheet P to which the manual mechanism portion 32 is set is transported to the transporting path 13 inside the housing 2 by the paper feeding roller 41.

Next, the paper feeding tray 42 will be described.

The paper feeding tray 42 is provided with the base portion 51, a pair of guides 52, a pair of protruding portions 53, and a pair of rollers 54.

The base portion 51 mainly forms a large portion of the appearance of the paper feeding tray 42. The base portion 51 is provided with an upper surface (a placing surface) 51*a*. The upper surface 51*a* of the base portion 51 is formed into a planar shape. The sheet P can be placed on the upper surface 51*a* of the base portion 51.

The base portion 51 is provided on an outer portion of the housing 2. The base portion 51 is obliquely inclined with respect to the housing 2. The base portion 51 is inclined so as to be positioned on the lower side as being extended in the X direction. An end portion 51*b* of the base portion 51 is connected to the housing 2. The end portion 51*b* of the base portion 51 is positioned on the lower side of the sheet importing port 45.

Next, the pair of guides (side guides) 52 will be described.

The pair of guides 52 is provided on the upper surface 51*a* of the base portion 51. The pair of guides 52 are separated from each other in the Y direction.

Figure 4:
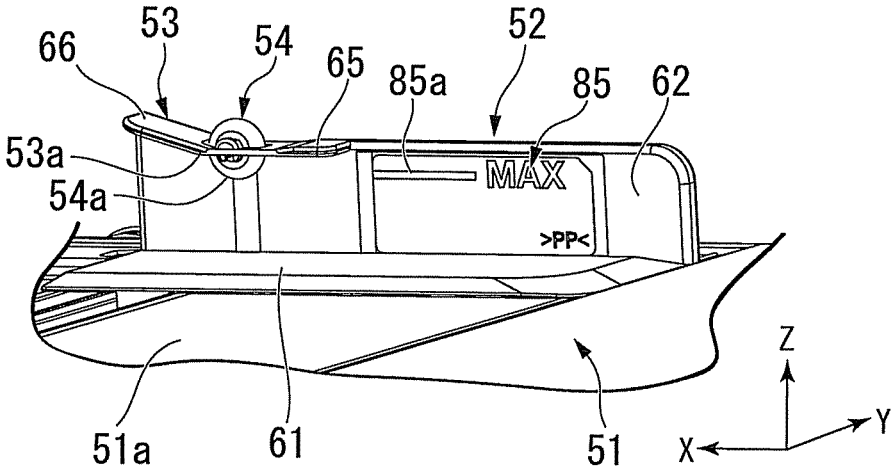
FIG. 4 is a perspective view illustrating a side guide as illustrated in FIG. 2.

FIG. 4 is enlarged view of one side of the guide 52. As illustrated in FIG. 4, each of the pair of guides 52 is provided with a base 61, and an erection portion 62.

The base 61 is attached to the base portion 51. The base 61 is slidably moved to the base portion 51. The base 61 is movable to the direction opposite to the Y direction with respect to the base portion 51. That is, the pair of guides 52 are movable to the directions which are close to each other and are separated from each other. With this, the pair of guides 52 is correspondable to the sheets P in a plurality of sizes.

The erection portion 62 erects in the Z direction with respect to the upper surface 51*a* of the base portion 51. The erection portion 62 erects in a plate shape. The erection portion 62 extends in the X direction. The erection portion 62 regulates a position of the sheet P, which is placed on the base portion 51, in the width direction (a position in the Y direction). With this, if the sheet P is transported to the housing 2 from the base portion 51, the pair of guides 52 guide both end portions of the sheet P in the width direction.

Next, the protruding portion 53 will be described.

Here, the pair of guides 52 have the same configurations as each other. For this reason, hereinafter, the protruding portion 53 and the roller 54 which are provided on one guide 52 are described as a representative. Note that, the protruding portion 53 and the roller 54 which are provided on the other guide 52 are configured in the same manner as described above.

As illustrated in FIG. 4, the protruding portion 53 is provided on an upper end portion of the erection portion 62 of the guide 52. Specifically, the protruding portion 53 protrudes the inner side of the pair of guides 52 from the upper end portion of the erection portion 62 of the guide 52. The protruding portion 53 is formed into the plate shape. The protruding portion 53 faces the sheet P when the sheet P is placed on the base portion 51. The protruding portion 53 faces the end portion of the sheet P in the width direction from the side opposite to the base portion 51.

Figure 5:
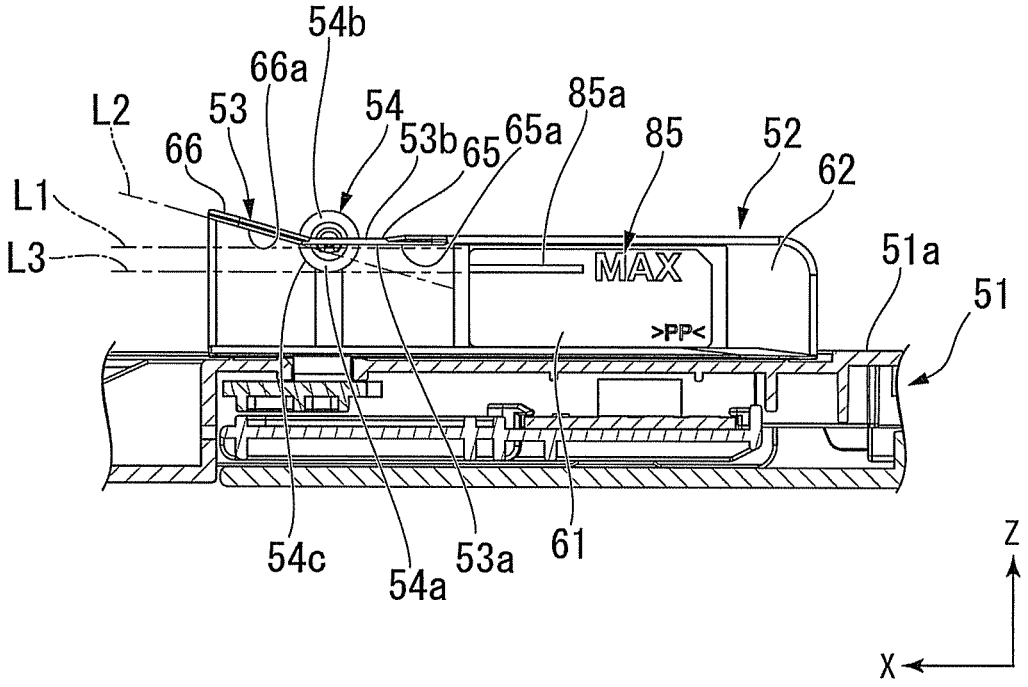
FIG. 5 is a sectional view illustrating the side guide as illustrated in FIG. 2.

FIG. 5 is an enlarged view of one side of the guide 52. As illustrated in FIG. 5, the protruding portion 53 is provided with a lower surface (a first surface) 53*a*, and an upper surface (a second surface) 53*b*. The lower surface 53*a* faces the upper surface 51*a* of the base portion 51. The upper surface 53*b* is positioned on the side opposite to the lower surface 53*a*.

In addition, the protruding portion 53 is provided with a first part 65 and a second part 66. The first part 65 extends substantially in parallel with the upper surface 51*a* of the base portion 51. The second part 66 extends toward the housing 2 from the first part 65. That is, the second part 66 further extends to the side of the X direction from the end portion on the side of the X direction of the first part 65. The second part 66 is inclined with respect to the upper surface 51*a* of the base portion 51. The second part 66 is inclined so as to be separated from the base portion 51 as extending in the X direction. With this, even when the first end portion E1 of the sheet P is curled (for example, an upward curl), the curled sheet P is difficult to strongly come in contact with the protruding portion 53.

Next, the roller (a pressing roller) 54 will be described.

Figure 6:
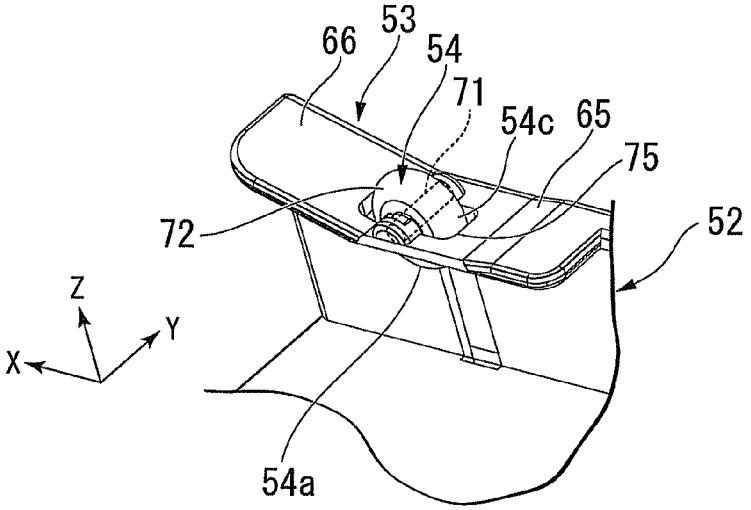
FIG. 6 is a perspective view illustrating a roller as illustrated in FIG. 4.

FIG. 6 is an enlarged view of the roller 54. As illustrated in FIG. 6, the roller 54 is rotatably attached to the protruding portion 53. Specifically, the roller 54 is provided with a rotation shaft 71 and a rotation body 72.

The rotation shaft 71 is disposed substantially in parallel with the upper surface 51*a* of the base portion 51. The rotation shaft 71 is disposed along the Y direction. Thus, the roller 54 is rotatable in the X direction.

The rotation body 72 is expanded from the rotation shaft 71. The rotation body 72 is expanded in the radial direction of the rotation shaft 71. The rotation body 72 is integrally formed with the rotation shaft 71. The rotation body 72 can be integrally rotated with the rotation shaft 71.

Materials of the roller 54 are not particularly limited. For example, the roller 54 is formed of a material having relatively a small coefficient of friction. For example, the roller 54 is made of plastic.

Next, a method of attaching the roller 54 to the protruding portion 53 will be described.

As illustrated in FIG. 6, the protruding portion 53 is provided with a hole 75. The hole 75 pierces through the protruding portion 53 in the Z direction. The hole 75 is a size larger than that of the rotation body 72 of the roller 54. A portion of the rotation body 72 of the roller 54 is inserted into the hole 75. With this, a lower end portion 54*a* of the roller 54 protrudes downward further than the lower surface 53*a* of the protruding portion 53. That is, the lower end portion 54*a* of the roller 54 protrudes toward the base portion 51 from the lower surface 53*a* of the protruding portion 53. On the other hand, an upper end portion 54*b* of the roller 54 protrudes upward further than the upper surface 53*b* of the protruding portion 53.

Figure 7:
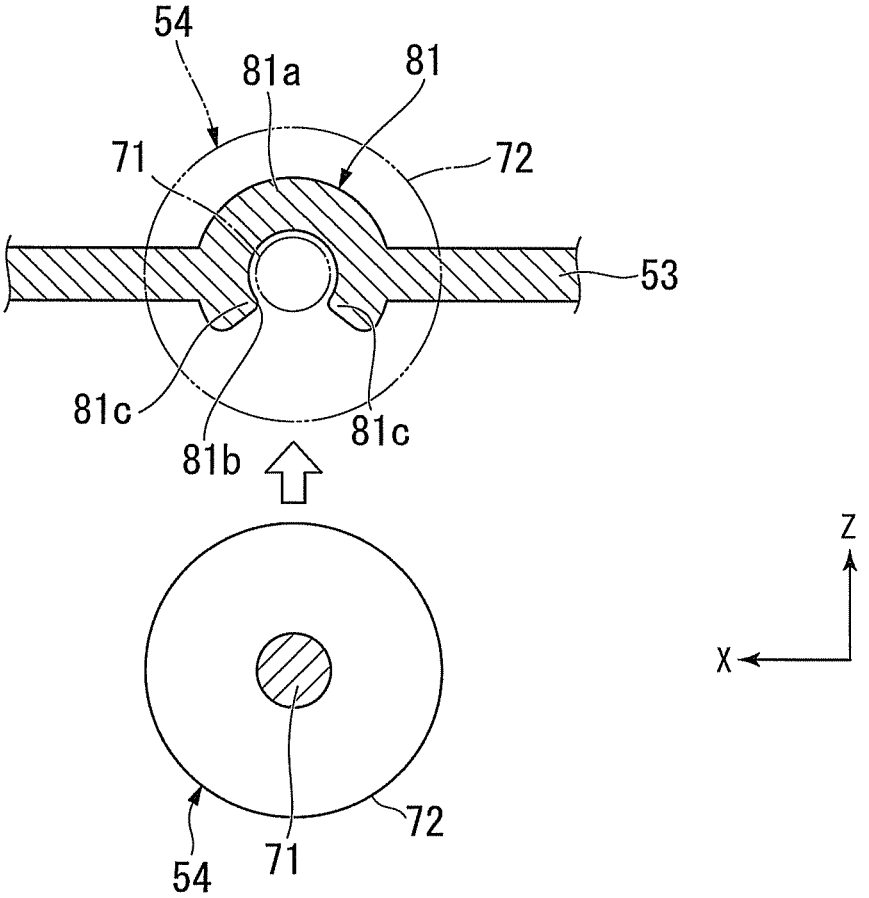
FIG. 7 is a sectional view illustrating a bearing portion as illustrated in FIG. 4.

FIG. 7 illustrates the protruding portion 53 which is formed in a sectional shape. As illustrated in FIG. 7, the protruding portion 53 is provided with a bearing portion 81. The bearing portion 81 rotatably supports the rotation shaft 71 of the roller 54. The bearing portion 81 is provided with a cover portion 81*a* which is positioned on the upper side of the rotation shaft 71 of the roller 54. The cover portion 81*a* is connected to the protruding portion 53 on both sides of the rotation shaft 71 of the roller 54 in the X direction. With this, the cover portion 81*a* is firmly supported by the protruding portion 53. When the roller 54 comes in contact with the sheet P, a force directed upward is applied to the rotation shaft 71 of the roller 54. The cover portion 81*a* presses the rotation shaft 71 of the roller 54 from upward. With this, the roller 54 is stably supported by the bearing portion 81. That is, even the force directed upward is applied to the rotation shaft 71 of the roller 54, the roller 54 is not easily released from the bearing portion 81.

On the other hand, the bearing portion 81 is provided with an insertion port 81*b* and a plurality of support portions 81*c*. The insertion port 81*b* opens downward. The rotation shaft 71 of the roller 54 is inserted into the inside of the bearing portion 81 from the insertion port 81*b*. With this, the rotation shaft 71 of the roller 54 is attached to the bearing portion 81.

The plurality of support portions 81*c* are positioned to be divided into both side of the insertion port 81*b* in the X direction. For example, the plurality of support portions 81*c* are projections protruding toward the insertion port 81*b*. A gap between the plurality of support portions 81*c* is slightly smaller than a diameter of the rotation shaft 71 of the roller 54. Thus, when the rotation shaft 71 of the roller 54 is inserted into the insertion port 81*b*, the support portion 81*c* is elastically deformed so as to widen the gap between the plurality of support portions 81*c*. With this, the rotation shaft 71 of the roller 54 is inserted into the inside of the bearing portion 81 through the support portion 81*c*. The plurality of support portions 81*c* support the rotation shaft 71 of the roller 54 from the lower side. With this, the roller 54 is not released from the bearing portion 81. Note that, the configuration of the bearing portion 81 is not limited to the above-described example.

Next, a position of the roller 54 with respect to the protruding portion 53 will be described.

As illustrated in FIG. 5, the roller 54 is provided at the end portion on the X direction side of the first part 65 of the protruding portion 53. In the exemplary embodiment, the roller 54 is provided at a boundary portion between the first part 65 and the second part 66 of the protruding portion 53.

Here, a virtual line (an extension line) L1 in FIG. 5 indicates a virtual line which passes through the lower surface 65*a* of the first part 65 of the protruding portion 53. The virtual line L1 extends substantially in parallel with the lower surface 65*a* of the first part 65 of the protruding portion 53. As illustrated in FIG. 5, at least a portion of the roller 54 is positioned on the lower side of the virtual line L1.

In addition, a virtual line (the extension line) L2 in FIG. 5 indicates a virtual line which passes through the lower surface 66*a* of the second part 66 of the protruding portion 53. The virtual line L2 extends substantially in parallel with the lower surface 66*a* of the second part 66 of the protruding portion 53. As illustrated in FIG. 5, at least a portion of the roller 54 is positioned on the lower side of the virtual line L2.

Thus, the sheet P which is placed on the upper surface of the base portion 51 comes in contact with the lower end portion 54*a* of the roller 54 before coming in contact with the first part 65 of the protruding portion 53. Similarly, the sheet P which is placed on the upper surface of the base portion 51 comes in contact with the lower end portion 54*a* of the roller 54 before coming in contact with the second part 66 of the protruding portion 53.

Next, a position of the roller 54 with respect to the sheet P will be described.

As illustrated in FIG. 5 and FIG. 6, the rotation body 72 of the roller 54 is provided with a circumferential surface 54*c*. When the sheet P is placed on the base portion 51, the circumferential surface 54*c* faces the end portion of the sheet P in the width direction.

Specifically, when the sheet P is placed on the base portion 51 less than a predetermined amount, the circumferential surface 54*c* of the roller 54 does not come in contact with the sheet P. That is, no gap exists between the circumferential surface 54*c* of the roller 54 and the sheet P.

On the other hand, when the sheet P is placed on the base portion 51 more than a predetermined amount, the circumferential surface 54*c* of the roller 54 comes in contact with the sheet P on the upper most surface. In this case, the circumferential surface 54*c* of the roller 54 presses the sheet P toward the base portion 51.

An example of "a predetermined amount" means a maximum load amount of the sheet P which can be placed on the base portion 51. In addition, the roller 54 may come in contact with the sheet P when the sheet P does not reach the maximum load amount. For example, when the sheet P is curled (for example, an upward curl), the roller 54 may come in contact with the sheet P even when the sheet P does not reach the maximum load amount. The roller 54 presses the curling of the sheet P toward the base portion 51. With this, the sheet P is smoothly transported to the sheet importing port 45.

Next, a position of the roller 54 with respect to the maximum load amount of the sheet P will be described.

As illustrated in FIG. 5, the guide 52 is provided with a display (a max instruction unit) 85 which displays the maximum load amount of the sheet P which can be placed on the base portion 51. The display 85 includes a line 85*a* illustrating an upper end (a load amount limit) of the maximum load amount of the sheet P. The line 85*a* is positioned on the lower side further than the lower surface 65*a* of the first part 65 of the protruding portion 53. Meanwhile, the display 85 may be a label or a carved seal. A method of forming the display 85 is not particularly limited.

The lower end portion 54*a* of the roller 54 is positioned at substantially the same height as that of the line 85*a* in the height in the direction perpendicular to the upper surface 51*a* of the base portion 51. That is, the lower end portion 54*a* of the roller 54 is positioned at the height corresponding to the upper end of the maximum load amount of the sheet P which can be placed on the base portion 51. Here, "the height in the direction perpendicular to the upper surface of the base portion" in the specification, means a distance between the upper surface 51*a* of the base portion 51 and an object in the Z direction in FIG. 3 or FIG. 5. That is, "the height in the direction perpendicular to the upper surface of the base portion" means the height from the upper surface 51*a* when the upper surface 51*a* of the base portion 51 is disposed in a horizontal manner.

From another point of view, as illustrated in FIG. 3, the lower end portion 54*a* of the roller 54 is positioned on the lower side further than the lower end portion 41*a* of the paper feeding roller 41 (a nip position of the paper feeding roller 41) in the height in the direction perpendicular to the upper surface 51*a* of the base portion 51. Here, the nip position of the paper feeding roller 41 means a position with which, with respect to the sheet P, the paper feeding roller 41 firstly comes in contact.

In addition, in other words, the above-described configuration can be described as follows. That is, a virtual line (the extension line) L3 in FIG. 3 illustrates a virtual line which passes through the lower end portion 54*a* of the roller 54. The virtual line L3 is in parallel with the upper surface 51*a* of the base portion 51. As illustrated in FIG. 3, the virtual line L3 passes through the lower side further than the lower end portion 41*a* of the paper feeding roller 41. That is, the paper feeding roller 41 is separated from the virtual line L3.

According to the image forming apparatus 1 in the above-described configuration, it is possible to reduce the transport failure of the sheet P.

That is, the back paper may be supplied to the manual paper feeding tray in some cases. The back paper is likely to be curled. For this reason, the paper feeding tray is generally provided with the protruding portion for pressing the curling of the back paper.

However, the sheet which has strong stiffness (for example, thick paper) compared to the typical sheet may be supplied to the paper feeding tray in some cases. The sheet having the strong stiffness is likely to be curled as a case of the typical sheet. When the sheet having the strong stiffness is curled, a load of contacting the curl and the protruding portion of the paper feeding tray becomes larger. For this reason, when the sheet having the strong stiffness is curled, the transport failure is likely to be generated.

The paper feeding unit 12 of the image forming apparatus 1 of the exemplary embodiment is provided with the base portion 51, the guide 52, the protruding portion 53, and the roller 54. The sheet P can be placed on the base portion 51. The guide 52 erects with respect to the base portion 51. The guide 52 regulates a position of the sheet P in the width direction. The protruding portion 53 is provided on the guide 52. The protruding portion 53 faces an end portion of the sheet P in the width direction from the side opposite to the base portion 51. The roller 54 is provided on the protruding portion 53. The roller 54 is provided with the circumferential surface 54*c* facing the end portion of the sheet P in the width direction. The roller 54 is rotatable in the transporting direction of the sheet P.

According to such a configuration, the sheet P comes in contact with the roller 54 before coming in contact with the protruding portion 53. The roller 54 is rotatable in the transporting direction of the sheet P. Thus, the roller 54 can be rotated in accordance with the transporting of the sheet P. Thus, a load of contacting the sheet P and the roller 54 is relatively small. Thus, it is possible to smoothly transport the sheet P. With this, it is possible to reduce the transport failure of the sheet P.

In the exemplary embodiment, the protruding portion 53 is provided with the lower surface 53*a* facing the base portion 51. The lower end portion 54*a* of the roller 54 protrudes toward the base portion 51 from the lower surface 53*a* of the protruding portion 53. According to such a configuration, the sheet P further easily comes in contact with the roller 54 before coming in contact with the protruding portion 53. With this, it is possible to further reliably reduce the transport failure of the sheet P.

In the exemplary embodiment, when the sheet P is placed on the base portion 51 more than a predetermined amount, the roller 54 presses the sheet P toward the base portion 51. With this, it is possible to smoothly guide the sheet P to the sheet importing port 45. With this, it is possible to further reduce the transport failure of the sheet P.

Here, the display of the maximum load amount of the sheet P will be taken into consideration. For example, in the configuration of not including the roller 54, it is also considered that the position of the lower surface 53*a* of the protruding portion 53 is set to the maximum load amount of the sheet P. However, in this configuration, when supplying a normal sheet, a load of contacting the sheet P and the lower surface 53*a* of the protruding portion 53 becomes larger in some cases. As a result, there is a possibility of the transport failure of the sheet P. Thus, in general, the display 85 which displays the maximum load amount of the sheet P is provided at a position on the lower side further than the lower surface 53*a* of the protruding portion 53.

In the exemplary embodiment, the guide 52 is provided with the line 85*a* which indicates the upper end of the maximum load amount of the sheet P which can be placed on the base portion 51. In the height in the direction perpendicular to the upper surface of the base portion 51, the lower end portion 54*a* of the roller 54 is positioned at substantially the same height as that of the line 85*a*.

That is, according to the configuration of the exemplary embodiment, since the load of contacting the roller 54 and the sheet P is small, even though the maximum load amount of the sheet P is regulated by the lower end portion 54*a* of the roller 54, the transport failure of the sheet P is less likely to be generated. For this reason, it is possible to regulate the maximum load amount of the sheet P by the lower end portion 54*a* of the roller 54.

Further, according to the configuration of the exemplary embodiment, it is possible to omit the display (the max instruction unit) 85 that displays the maximum load amount of the sheet P which can be placed on the base portion 51. If the display 85 can be omitted, it is possible to achieve the low cost of the image forming apparatus 1.

In the exemplary embodiment, the paper feeding unit 12 is provided with the paper feeding roller 41 which transports the sheet P to the inside of the housing 2. The lower end portion 54*a* of the roller 54 is positioned on the lower side further than the nip position of the paper feeding roller 41 at the height in the direction perpendicular to the upper surface 51*a* of the base portion 51. According to such a configuration, similar to the above description, it is possible to regulate the maximum load amount of the sheet P by using the lower end portion 54*a* of the roller 54. For this reason, according to the above-described configuration, it is possible to omit the display 85 for displaying the maximum load amount of the sheet P which can be placed on the base portion 51. With this, it is possible to achieve the low cost of the image forming apparatus 1.

In the exemplary embodiment, the protruding portion 53 is provided with a first part 65 extending substantially in parallel with the upper surface 51*a* of the base portion 51. The roller 54 is provided at the end portion of the first part 65 on the transporting direction side. According to such a configuration, the roller 54 can press the sheet P until the second end portion E2 of the sheet P completely passes through the lower side of the first part 65 of the protruding portion 53. With this, it is possible to further reliably reduce the possibility of contacting the sheet P and the first part 65. With this, it is possible to further reliably reduce the transport failure of the sheet P.

In the exemplary embodiment, the protruding portion 53 is provided with the second part 66 extending to the transporting direction side from the first part 65. The second part 66 is inclined to the direction separated from the base portion 51 as being extended in the transporting direction of the sheet P. The roller 54 is provided in the boundary portion between the first part 65 and the second part 66. According to such a configuration, it is possible to reduce the possibility of contacting the sheet P and the first part 65 and to reduce the possibility of contacting the sheet P and the second part 66. With this, it is possible to further reliably reduce the transport failure of the sheet P. In addition, the second part 66 is inclined to the direction separated from the base portion 51 as being extended in the transporting direction of the sheet P. Thus, even though the second part 66 and the sheet P contact each other, the contact load becomes smaller as compared with a case of contacting the first part 65 and the sheet P. That is, it can be said that the exemplary embodiment is configured to make the possibility of contacting the second part 66 and the sheet P as small as possible and to reliably prevent the first part 65 and the sheet P from contacting to each other.

In the exemplary embodiment, the protruding portion 53 is provided with the hole 75 which pierces through the direction perpendicular to the upper surface 51*a* of the base portion 51. A portion of the roller 54 is inserted into the hole 75. According to such a configuration, it is possible to set the thickness required for the roller 54 and the protruding portion 53 to be thin. With this, it is possible to achieve the thinning of the manual mechanism portion 32.

In the exemplary embodiment, the protruding portion 53 is provided with the bearing portion 81 which supports the rotation shaft 71 of the roller 54. The bearing portion 81 is provided with the insertion port 81*b* into which the rotation shaft 71 of the roller 54 can be inserted from the lower side. Here, when the roller 54 comes in contact with the sheet P, force directed upward is applied to the rotation shaft 71 of the roller 54. However, according to the above-described configuration, the bearing portion 81 can stably support the rotation shaft 71 of the roller 54 from the upper side. With this, problems in the rotation of the roller 54 are less likely to be generated. With this, it is possible to further reliably reduce the transport failure of the sheet P.

Hereinbefore, the image forming apparatus 1 of the exemplary embodiment has been described. Meanwhile, the image forming apparatus of the exemplary embodiment is not limited to the above-described example. For example, the protruding portion 53 may not be provided with the second part 66. That is, the protruding portion 53 may be formed only by the first part 65.

Here, the image forming apparatus 1 of the above-described exemplary embodiment has a decoloring function which decolors the image formed on the sheet P. Here, the "decolor" in the present specification means that an image formed by the color (including not only a chromatic color but also an achromatic color such as white, black) which is different from the base color of the sheet is not visually shown (for example, colorless). For example, the image forming apparatus 1 decolors the image of the sheet P passing through the fixing portion 15 by controlling a temperature of the fixing portion 15 to a decoloring temperature. Thus, the image forming apparatus 1 is also an example of a "decoloring apparatus". Note that, the configuration of the above-described exemplary embodiment (for example, a structure of the manual mechanism portion 32) may be applied to the decoloring apparatus which does not have an image forming function. In addition, in the specification, a combination of the "image forming apparatus" and "decoloring apparatus" is referred to as an "image processing apparatus".

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming apparatus comprising:

a paper feeding unit that includes a base portion on which a sheet can be placed, the base portion being provided on an outer portion of a housing, a paper feeding roller which transports the sheet to an inside of the housing, a guide which erects with respect to the base portion and regulates a position of the sheet in a width direction which intersects with a transporting direction of the sheet, a protruding portion which is provided on the guide and faces an end portion of the sheet in the width direction from a side opposite to the base portion, the protruding portion including a first part and a second part, the first part extending substantially in parallel with an upper surface of the base portion, the second part extending to the transporting direction side from the first part, the second part being inclined to a direction separated from the base portion as being extended in the transporting direction, and a roller which is provided is in a boundary portion between the first part and the second part of the protruding portion, is provided with a circumferential surface facing the end portion of the sheet, and is rotatable in the transporting direction of the sheet, the roller having a lower end portion which is positioned on a lower side further than a nip position of the paper feeding roller at a height in a direction perpendicular to the upper surface of the base portion.

2. The apparatus according to claim 1, wherein the protruding portion includes a lower surface facing the base portion, and wherein the lower end portion of the roller protrudes toward the base portion from the lower surface of the protruding portion.

3. The apparatus according to claim 1, wherein when the sheet is placed on the base portion with a predetermined amount or more, the roller presses the sheet toward the base portion.

4. The apparatus according to claim 1, wherein the guide includes a line illustrating an upper end of a maximum load amount of the sheet which can be placed on the base portion, and wherein the lower end portion of the roller is positioned at substantially the same height as that of the line at a height in the direction perpendicular to the upper surface of the base portion.

5. The apparatus according to claim 1, wherein the lower end portion of the roller is positioned at a height corresponding to an upper end of a maximum load amount of the sheet which can be placed on the base portion.

6. The apparatus according to claim 1, wherein the protruding portion includes a hole which passes through the direction perpendicular to the upper surface of the base portion, and wherein a portion of the roller is inserted into the hole.

7. The apparatus according to claim 1, wherein the protruding portion includes a bearing portion which supports a rotation shaft of the roller, and wherein the bearing portion includes an insertion port into which the rotation shaft of the roller is able to be inserted from the lower side.

8. An image forming apparatus comprising:

a paper feeding unit that includes a base portion on which a sheet can be placed, the base portion being provided on an outer portion of a housing, a paper feeding roller which transports the sheet to an inside of the housing, a guide which erects with respect to the base portion and regulates a position of the sheet in a width direction which intersects with a transporting direction of the sheet, a protruding portion which is provided on the guide and faces an end portion of the sheet in the width direction from a side opposite to the base portion, the protruding portion including a bearing portion which includes an insertion port, and a roller which is provided on the protruding portion, is provided with a circumferential surface facing the end portion of the sheet, and is rotatable in the transporting direction of the sheet, a rotation shaft of the roller being supported by the bearing portion, the rotation shaft of the roller being able to be inserted into the insertion port of the bearing portion from the lower side, and the roller having a lower end portion which is positioned on a lower side further than a nip position of the paper feeding roller at a height in a direction perpendicular to an upper surface of the base portion.

9. The apparatus according to claim 8, wherein the protruding portion includes a lower surface facing the base portion, and wherein the lower end portion of the roller protrudes toward the base portion from the lower surface of the protruding portion.

10. The apparatus according to claim 8, wherein when the sheet is placed on the base portion with a predetermined amount or more, the roller presses the sheet toward the base portion.

11. The apparatus according to claim 8, wherein the guide includes a line illustrating an upper end of a maximum load amount of the sheet which can be placed on the base portion, and wherein the lower end portion of the roller is positioned at substantially the same height as that of the line at a height in the direction perpendicular to an upper surface of the base portion.

12. The apparatus according to claim 8, wherein the lower end portion of the roller is positioned at a height corresponding to an upper end of a maximum load amount of the sheet which can be placed on the base portion.

13. The apparatus according to claim 8, wherein the protruding portion includes a first part which extends substantially in parallel with the upper surface of the base portion, and wherein the roller is provided at an end portion of the first part on a transporting direction side.

14. The apparatus according to claim 8, wherein the protruding portion includes a hole which passes through the direction perpendicular to the upper surface of the base portion, and wherein a portion of the roller is inserted into the hole.

* * * * *